United States Patent [19]

Dollison

[11] Patent Number: 4,776,401

[45] Date of Patent: Oct. 11, 1988

[54] FOOT VALVE FOR PUMPING WELLS

[75] Inventor: William W. Dollison, Dallas, Tex.

[73] Assignee: Otis Engineering Corporation, Dallas, Tex.

[21] Appl. No.: 85,788

[22] Filed: Aug. 17, 1987

[51] Int. Cl.[4] ..... E21B 43/00; F04B 7/00

[52] U.S. Cl. ..... 166/369; 166/373; 166/108; 417/448

[58] Field of Search ..... 166/106, 108, 110, 369, 166/373, 386; 417/448, 449, 450

[56] References Cited

U.S. PATENT DOCUMENTS

| | | | |
|---|---|---|---|
| 233,549 | 10/1880 | Rose | 166/108 |
| 1,832,323 | 11/1931 | Rigby | 166/108 |
| 2,180,605 | 11/1939 | Otis . | |
| 2,189,703 | 2/1940 | Burt et al. . | |
| 2,384,192 | 9/1945 | Otis et al. . | |
| 4,286,663 | 9/1981 | Mittle | 417/450 X |
| 4,662,831 | 5/1987 | Bennett | 166/106 X |

*Primary Examiner*—Jerome W. Massie
*Assistant Examiner*—William P. Neuder
*Attorney, Agent, or Firm*—Albert W. Carroll

[57] ABSTRACT

Methods of and apparatus for plugging a well below a rod pump to permit bleeding off the pressure thereabove so that the pump can be removed from the well for replacement or repairs and reinstalled for further pumping operations, the pump being connected to a valve mechanism in the well in a manner which permits the valve to be closed as a result of lifting the pump, this connection being releasable to permit the pump to be pulled free of the valve and withdrawn from the well after the well pressure has been bled from above the closed valve. When the pump is installed again, the pump automatically reconnects to the valve. This invention is particularly useful in wells which are stimulated by the injection of steam.

14 Claims, 3 Drawing Sheets

FOOT VALVE FOR PUMPING WELLS

BACKGROUND OF THE INVENTION

1. Field of the Invention

This invention relates to well tools, and more particularly to foot valves, especially such foot valves as may be used in pumping wells, for instance.

2. Description of Related Art

It has been common practice to use well pumps which are actuated by sucker rods moved up and down by a surface unit (pump jack, or the like), thus stroking the piston in the pump barrel to pump well liquids from the well. Such pumps commonly are seated in a pump seating nipple. The sucker rod string, being attached to the pump, is utilized in retrieving and re-running the pump for replacement or repairs.

Some wells may have sufficient surface pressure at times that the pump cannot be removed therefrom safely. Thus, it may be necessary to "kill" the well in order that the replacement operation may be carried out safely. It is desirable to have the ability to shut-in the well below the pump in order that the well pressure may be bled off, thus making it safe to open the well to the atmosphere before removing the pump. For this operation, a spring-loaded flapper valve has been used below the pump, and this valve has been held open by an extension or probe on the lower end of the pump which extends past the flapper valve when the pump is seated in its seating nipple. Upon lifting the pump a few inches, the flapper valve is allowed to close, after which the well pressure may be bled off. Great difficulties have arisen in pumping wells in this manner where such wells have steam injected thereinto at a temperature of about 600 degrees Fahrenheit (316 degrees Celsius). At such elevated temperature, the flapper valve spring has been unreliable, having a very short life. When the spring fails, the flapper valve will not move to closed position when the pump is lifted. This, then, creates a very expensive problem since it requires killing the well.

Flapper valves have been used on well packers for closing the bore therethrough upon withdrawal of the seal mandrel from its normal position in which it holds the flapper valve open. This is clearly disclosed in U.S. Pat. No. 2,189,703 which issued to Clarence E. Burt and Eugene Graham, Jr. on Feb. 6, 1940.

Applicant is aware of the just-mentioned U.S. Pat. No. 2,189,703 as well as U.S. Pat. Nos. 2,180,605 and 2,384,192.

U.S. Pat. No. 2,180,605 issued to Herbert C. Otis on Nov. 21, 1939 and discloses a plug (or closing tool) for plugging the lower end of a well tubing so that such tubing can be run into a well under pressure control. After the tubing has been run to depth, the tubing is pressured to move the plug from its seat and allowing it to drop to a bull plug below a plurality of perforations. Well fluids may then enter the tubing through such perforations and flow to the surface in the usual manner. Should it thereafter become necessary to remove the tubing from the well, a lifting tool is run into the tubing on a wire line or cable, the plug is engaged and lifted to its plugging position, pressure is bled from above it and the lifting tool disengaged therefrom, leaving the lower end of the tubing plugged.

U.S. Pat. No. 2,384,192 issued to Herbert C. Otis and John C. Luccous on Sept. 4, 1945. This patent shows a flapper valve like that of U.S. Pat. No. 2,189,703 and a plug (or closing tool) like that of U.S. Pat. No. 2,180,605.

None of the prior art with which applicant is familiar discloses a plug for use below a well pump, which plug is held in a non-plugging position when the pump is seated in its pump seating nipple and then is bodily lifted to its plugging position to plug the well below the pump when the pump is lifted from its pump seating nipple.

The device of the present invention is ideally suited to applications such as that described above.

SUMMARY OF THE INVENTION

The present invention is directed toward a plugging device for plugging a pumping well below a well pump to enable the well pressure to be bled off thereabove and the pump removed from the well, the device comprises a housing attachable to the well tubing below the pump seating nipple, the housing having lateral ports intermediate its ends, an internal annular seat surface above such ports and internal support shoulder means below said ports, a foot valve in said housing normally supported on said support shoulder and having an annular seat surface thereon engageable with the seat surface of said housing to plug the tubing, the foot valve having a stem extending upwardly therefrom, and operating means attachable to the well pump and latchable onto the stem of said foot valve when said pump is placed in engagement with its seating nipple, said foot valve being liftable from its lower position wherein it is supported upon said support shoulder in said housing to its plugging position wherein it is in engagement with said seating surface when said well pump is lifted a short distance, then after the well prssure is reduced, the operator means on the pump is disengaged from the stem of the foot valve responsive to a predetermined upward pull, thus releasing the pump from the foot valve for withdrawal from the well.

The present invention is also directed toward methods for plugging a well below a well pump using a foot valve which is lifted to plugging position automatically as the pump is unseated and lifted a short distance after which well pressure is reduced and the pump disconnect from the plug withdrawn from the well.

It is therefore one object of this invention to provide a valve for plugging a well below a well pump to permit removal of the pump from the well.

Another object is to provide such valve in the form of a poppet-type foot valve having a stem projecting from its upper end, and a foot valve nipple for housing the foot valve, the nipple having lateral inlet ports, an annular seat surface above the ports and a support shoulder below the ports, the foot valve being engageable with the annular seat surface to plug the foot valve nipple above the ports but resting upon the support shoulder when it is in its lower, non-plugging position.

Another object is to provide such a foot valve having its stem extending upwardly therefrom a sufficient distance to project beyond said annular seat surface in said nipple when the foot valve is resting upon said support shoulder.

A further object is to provide such a plugging device wherein the position of the support shoulder in the nipple is adjustable as desired, and further wherein the support shoulder is an annular ring threadedly held in the landing nippl, the thread being of adequate length for proper adjustment of the ring's position.

Another object of this invention is to provide an operator for moving the foot valve between its lower, open position and its upper, plugging position, this operator mechanism being connectable to the lower end of a well pump and having a portion thereof latchable onto the foot valve.

A further object is to provide such an operator mechanism wherein the latch mechanism automatically engages the foot valve stem when the well pump is installed in the well.

Another object is to provide such an operator mechanism wherein when the pump is lifted, the foot valve will be lifted to its plugging position.

Another object is to provide such an operator mechanism wherein the latching portion includes collet means slidable between upper latching and lower releasing positions in a housing attached to the lower end of a well pump, wherein when the collet is in its lower, releasing position its dependent fingers spread outwardly, then when the collet is pushed down over the stem of the poppet valve, the collet is moved under a predetermined axial load to its upper position wherein the collet fingers are held in a contracted position with their internal bosses engaged below a downwardly facing fishing shoulder near the upper end of the foot valve stem.

Another object is to provide such an operator mechanism wherein the collet mechanism includes a detent mechanism for detaining the collet in its upper position but is releasable for movement toward its lower position in response to a predetermined tensile load for releasing the well pump from the poppet valve to leave the same in plugging position so that the pump may be removed from the well, the well pressure being reduced after the foot valve is in its upper, closed position and before the well pump is unlatched therefrom.

Another object is to provide methods for plugging a well below a well pump so that well pressure may be reduced above the plug and the well pump thereafter removed.

Another object is to provide such methods for reinstalling such pump by lowering it into the well with the foot valve operator mechanism in released condition, engaging the latching mechanism with the foot valve and seating the pump in its seating nipple, the well being pressurized to equalize pressures across the poppet valve just prior to seating the pump.

Other objects and advantages of this invention will become apparent from reading the description which follows and from studying the accompanying drawing wherein:

DESCRIPTION OF THE PREFERRED EMBODIMENT

Figure 1:
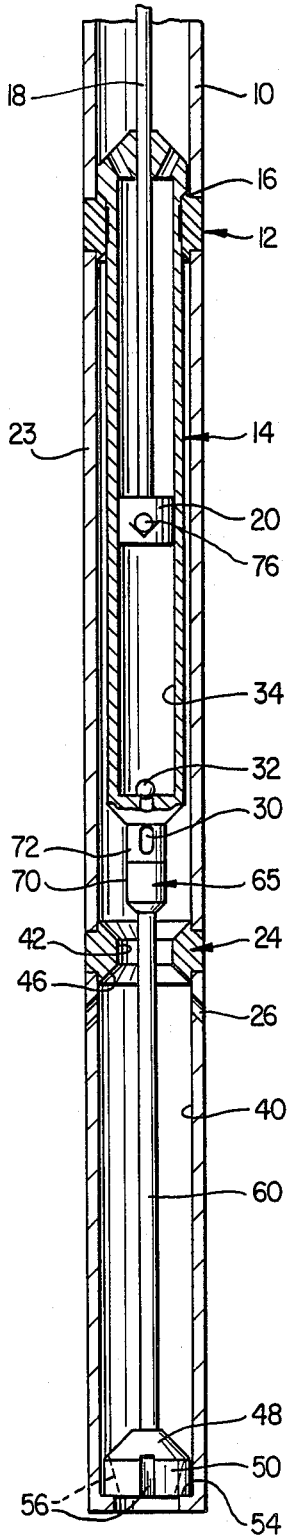
FIG. 1 is a schematical view of the lower portion of the tubing of a pumping well showing a well pump and plugging mechanism installed therein in accordance with the present invention.

Referring now to FIG. 1, it will be seen that the well tubing 10 is provided with a pump seating nipple 12 and that a well pump 14 is seated and sealed in said pump seating nipple in the usual and well-known manner. While the pump 14 is shown to have its upper end seated as at 16, it could as well have its lower end seated instead, which is the case with many other well-known pumps. Pump 14 is operated by a string of sucker rods 18 which are lifted and lowered to stroke the piston 20 in the usual manner for pumping well fluids to the surface.

Spaced below the pump seating nipple 12 by a pup joint or spacer pipe 23 is a ported foot valve nipple 24 which is provided with lateral ports 26 through which well fluids may enter the tubing. Such fluids then flow upwardly, enter the inlet 30 near the lower end of the pump, then flow upwardly past the standing valve 32 and into the pump barrel 34 to be lifted toward the surface on the next up-stroke of the piston 20.

Figure 4:
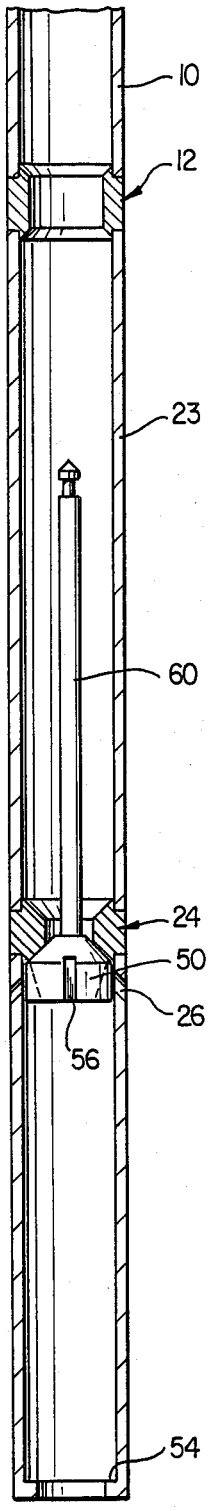
FIG. 4 a schematical view, similar to FIG. 1, but showing the lower portion of the well tubing with the foot valve in position plugging the tubing above the lateral ports, and with the well pump removed.

The foot valve nipple 24 has a bore 40 which is reduced as at 42 providing a downwardly facing internal annular seat surface 46 to be engaged by a corresponding seat surface 48 on the poppet type foot valve 50 when the foot valve is lifted from its lower position (shown in FIG. 1) to its upper position seen in FIG. 4. The seat surface 46 of the foot valve nipple obviously limits upward movement of the poppet valve. Downward movement of the foot valve is limited by the stop shoulder 54 at the lower end of the plug seating nipple. Stop shoulder 54, while shown in the schematical views (Figures 1 and 4) to be an internal flange formed integral with the foot valve nipple, is preferably a threaded ring screwed into a long thread so that its position relative to the pump seating nipple and, therefore, the pump, may be adjusted rather closely. Thus, the adjustment will make allowance for variations in the longitudinal dimensions of the various parts of the apparatus.

The foot valve 50 is preferably formed with one or more bypass grooves or slots 56 extending longitudinally thereof and inclined downwardly and inwardly to run out at its lower end, as shown, to permit fluids to pass the poppet valve in either an upwardly or a downwardly direction as needed. Such fluid flow past the poppet valve will tend to prevent sand and/or other solids from setting thereon or being deposited therearound.

A foot valve operator is provided for releasably connecting the pump 14 to the upper end of stem 60 of the foot valve 50 and is indicated generally by the reference numeral 65. The upper end portion of the stem 60 is formed with a downwardly facing shoulder 61 provided by the external annular groove 62, thus forming what is commonly termed a fishing neck.

Figure 2A:
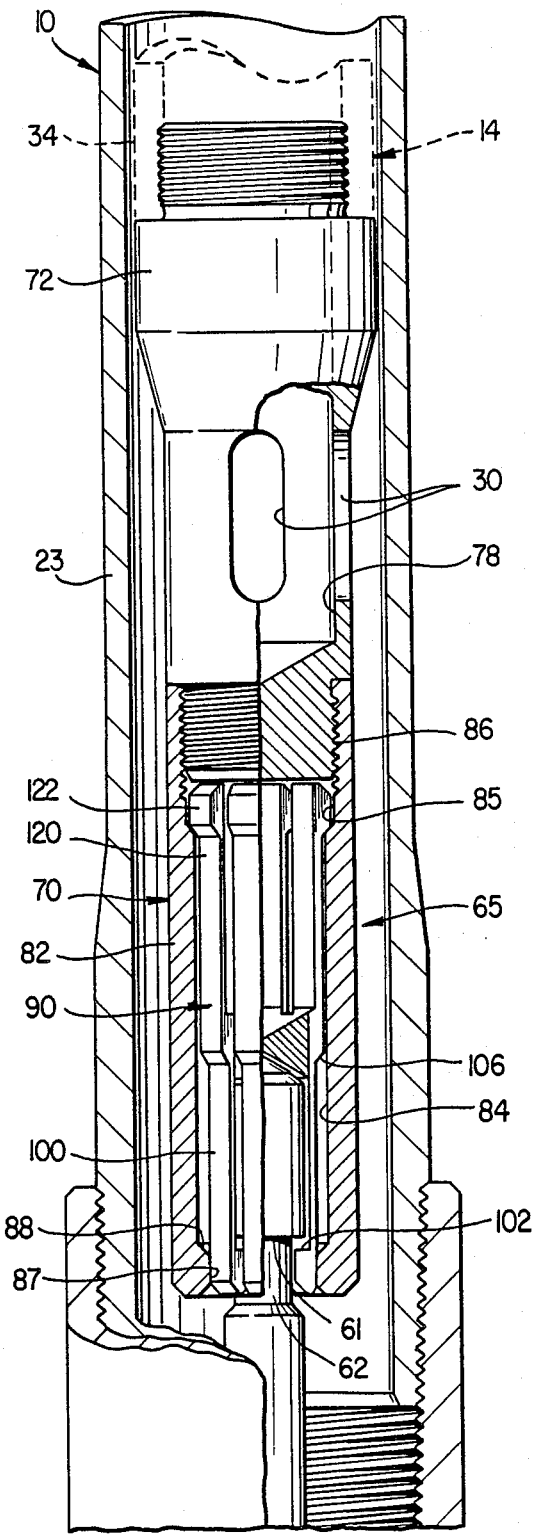
FIGS. 2A and 2B together, constitute a fragmentary longitudinal sectional view, with some parts in elevation and some parts broken away, showing the device of this invention to the lower end of a well tubing.

The foot valve operator 65 comprises a latch housing 70 which is connected to the lower end of the pump 14 by the adapter 72. The adapter 72, rather than being screwed onto the normal barrel cage bushing (which would need to be threaded), is preferably formed as shown in FIG. 2A and is screwed to the lower end of the pump, as shown, in the place of the normal barrel cage bushing. The standing valve 32 (shown) and its seat (not shown) would be supported on the upper end of the adapter 72. Thus, fluids entering the fluid inlets 30 of adapter 72 have free passage up through the standing valve seat (not shown) and past standing valve 32 into the pump barrel beneath the piston 20. The piston 20 carries the traveling valve 76 in the usual manner.

The adapter 72, shown in FIG. 2A, has a bore 78 which is preferably blind in that it stops short of the lower end thereof. The bore 78 could extend completely through the adapter, but this would likely encourage sand or other debris to settle into and foul the latch mechanism immediately therebelow.

The latch mechanism 70 of the foot valve operator 65 includes a latch housing 82 having a bore 84 which is enlarged as at 85 and is threaded as at 86 for attachment to the lower end of adapter 72. It is readily seen that an internal annular recess 85 is provided by the enlargement of bore 84. Bore 84 is decreased near its lower end as at 87, providing an upwardly facing shoulder 88 which is inclined inwardly and downwardly.

Inside the latch housing 82 there is disposed a latch and detent arrangement which will now be described. The collet 90 is shown to be a double-ended collet and is formed with a plurality of dependent collet fingers 100, each having an internal boss providing an upwardly facing shoulder 102. These dependent collet fingers 100 are inherently sprung outwardly for a purpose to be explained.

To deform the collet fingers 100 so that they flare, or assume a greater span when not confined by restricted bore 87 of housing 82 as they are shown to be in FIG. 2A, a plug (not shown) of predetermined size is wedged between them to hold them in the desired position during the heat-treating process. (FIG. 3 shows these fingers in their flared position.)

Figure 3:
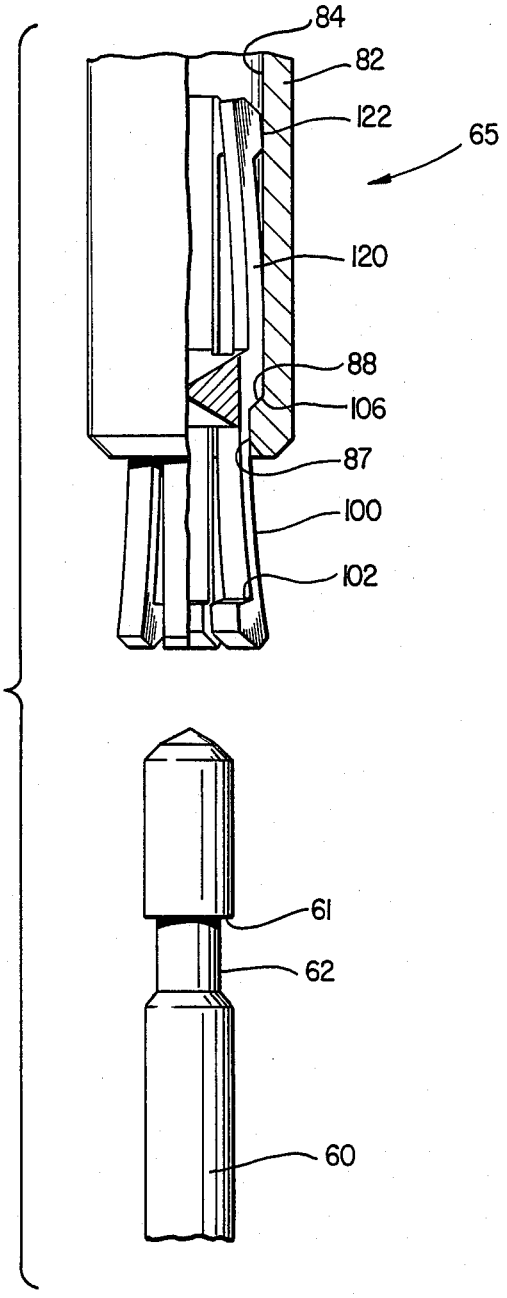
FIG. 3 is a fragmentary longitudinal view, partly in elevation and partly in section, showing the lower portion of the latch mechanism of this invention as it would appear just before latching onto the upper end of the foot valve stem or just after bein therefrom.

The collet 90 has its lower portion reduced in outside diameter to provide an inclined downwardly facing shoulder as at 106, which shoulder is engageable with upwardly facing shoulder 88 in the housing 82 to limit downward movement of the collet as shown in FIG. 3.

Figure 2B:
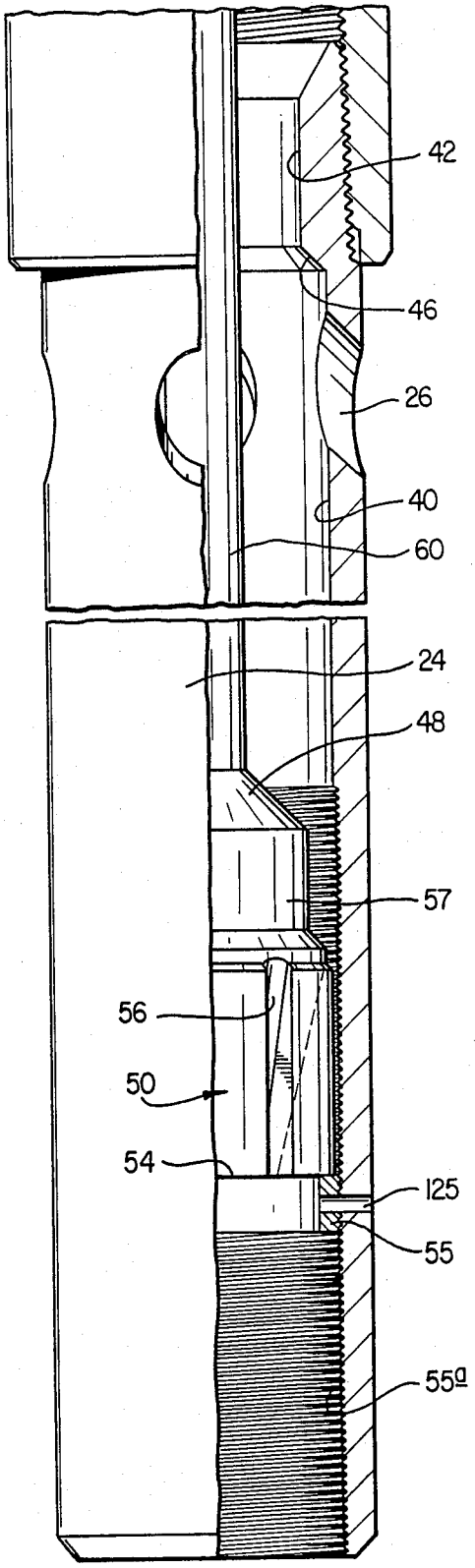

The collet 90 is also formed with upstanding fingers 120 each having an external boss 122 thereon which engage in the internal annular recess 85 of latch housing 82 when the collet 90 is in its upper position, shown in FIG. 2A. These external bosses 122 thus engaged in internal recess 85 detain the collet in its illustrated upper position and a predetermined, downwardly acting axial load is required to displace the collet from such upper position. Thus, if the pump 14, as seen in FIGS. 2A–2B, is lifted until the seat surface 48 the foot valve 50 is seated against seat surface 46 of the foot valve nipple. Pessure is then vented from the tubing above the foot valve 15 and the greater pressure therebelow will hold the foot valve firmly seated, The lifting force is increased until it reaches the predetermined axial load just mentioned, at which time the detent power of the upstanding collet fingers will be overcome and the pump will be lifted relative to the collet until the dependent collet fingers 100 spring outward and release their hold of the upper end of foot valve stem 60. Thus, the upwardly facing shoulders 102 of the internal bosses of dependent collet fingers 100 move radially outwardly sufficiently far to permit the collet to be lifted free. Thus, the foot valve operator 65 is released from the foot valve stem, which disconnects the pump from the plug, as seen in FIG. 3, leaving the tubing bore plugged as seen in FIG. 4.

In making ready the foot valve, foot valve seating nipple, operator, and pump for installation for the first time, the foot valve 50 is placed in the foot valve nipple 24 with the upper end of its stem 60 extending considerably above the restricted bore 42 which provides seat surface 46. The foot valve seating nipple is then screwed to the pump seating nipple with a spacer pipe or pup joint 23 of proper length therebetween.

The foot valve operator 65 and the adapter 72 are screwed together and then, having the standing valve ball 32 and seat (not shown) in the lower end of the pump, the adapter 72 is attached and tightened. It is imperative that the collet 90 be in its lower position as seen in FIG. 3 with the dependent collet fingers 100 flared to receive the upper end of the foot valve stem. The pump is then inserted into the pump seating nipple and is seated thereagainst and held in that position.

The threaded ring 55 which provides the stop shoulder 54 is screwed into thread 55a of the foot valve seating nipple and may be run up a short distance toward the upper end thereof. The pump and the foot valve are then connected together by pushing the foot valve toward the pump while making certain that the upper end of the stem is received between the dependent collet fingers. Considerable force will be required to force the collet fingers 100 into restricted bore 87 of the latch housing. When the pump and foot valve are connected together as shown in FIGS. 1-2B, they can be separated only by overcoming the resistance provided by the bosses 122 of upper collet fingers 120 engaged in the internal recess 85 of the latch housing 82, as before explained.

The position of ring 55 must be adjusted. With the tubular parts (foot valve seating nipple 24, spacer 23, and pump seating nipple 16) made up tightly, the stop ring 55 is adjusted upwardly to engage the lower end of the poppet valve and push it upwardly until the stem 60 pushes the collet mechanism upwardly in the latch housing 82 so far that it abuts or jams against the lower end of the adapter 72. The stop ring is then backed off about one-sixteenth inch (about 1.5 to 1.8 millimeters). This adjustment assures that the pump will latch to the stem when the poppet valve is in its lowermost position being supported by the support ring and that the pump will not pound the collet, stem, or foot valve. However, if the stop ring is too far below the pump, the pump will not be latched to the foot valve when the pump is seated again because the collet will not be pushed high enough for collet finger bosses 122 to enter the internal recess of the latch housing. The proper position of the stop ring 55 is now fixed by some suitable means such as placing a roll pin, or the like, in a hole drilled through the walls of the ring and nipple as shown in FIG. 2B, or by using a second threaded ring and jamming it tightly against stop ring 55. In FIG. 3, the pin used for this purpose is indicated by the reference numeral 125.

It is preferable that the foot valve seating nipple 24 be so dimensioned as to provide about 36 to 40 inches (0.9 to 1 meter) between the seating surface 46 of the nipple and the seating surface 48 of the foot valve to provide adequate vertical space for proper operation of the device which is now to be described.

In installing the device in a well, the foot valve seating nipple with the stop ring properly adjusted and secured and with the spacer pipe 23 and pump seating nipple 24 assembled thereto as previously described, is attached to the lower end of the well tubing and run into the well. After the tubing is installed, the well pump, with the foot valve operator, that is, the adapter and latching mechanism attached to its lower end and with the dependent collet fingers extending downwardly from the housing and in flared position, is run into the well on the rod string. As the pump is lowered into the pump seating nipple, the dependent fingers 100 will telescope over the upper end of the foot valve stem 60. The upper end of the stem will stop the descent of the collet mechanism and further lowering of the pump causes the confined bore 87 of the latch housing 82 to force the dependent collet fingers 100 radially inwardly so that their internal bosses engage beneath the downwardly facing fishing shoulder 61 of the poppet valve stem 60. The pump 14 will at that time become fully seated in the pump seating nipple 12, and the upper ends of the upstanding collet fingers will be engaged in the internal recess 85 of the latch housing 82 and will be spaced from the lower end of the adapter 72 about one-sixteenth inch, as previously adjusted. The pump is then in pumping position.

When it is desired to remove the pump from the well, it is lifted about 40 inches, or until resistance is noticed, to lift the foot valve to its plugging position. Bleeding some pressure from the well will indicate whether or not the foot valve is plugging the nipple. It should be understood here that the restricted bore 42 which provides the downwardly facing seating surface 46 of the foot valve seating nipple is a fairly close fit with that portion 57 of the foot valve 50 which is immediately below its seating surface 48, so that if the pump does not lift the foot valve quite high enough, relieving well pressure above the poppet valve will lift the poppet valve the remainder of the way to full plugging position. This close fit greatly restricts the flow therethrough and prevents throttling across the seating surfaces, protecting them from flow-cutting action.

After the foot valve 50 has been seated as just described and pressure thereabove has been reduced somewhat below the magnitude of the pressure therebelow, the difference between these two pressures will act upwardly to hold the foot valve 50 in its thus seated position. The pump at this time will be pulled free of the foot valve to effect a disconnect, after which the pump may be lifted to the surface. It should be understood, however, that it will generally be preferable to bleed the well pressure to equal atmospheric as soon as it has been determined that the foot valve has been seated. Then the pump and sucker rods can be pulled from the well without the necessity of pulling them under pressure control as through use of a stripper or other type of blowout prevention equipment.

The device of this invention is particularly suitable for use in wells which are stimulated by steam injection. In the operation of such wells, steam at high temperature is injected into the oil production zone through the well tubing for a period of several days, and maybe 30 days, or more. The hot steam increases both the pressure and the temperature of the formation. Wells requiring such steam stimulation usually produce heavy oil, and the high temperature of the steam greatly reduces the oil's viscosity, making it much more flowable.

Generally, after steam has been injected into the producing formation for a substantial period of time, the increased bottom hole pressure and the increased flowability of the oil permit the well to be flowed for several days, and possibly a month. After the period of free flow, the well may be pumped for a month or more. Occasionally the pump will need to be removed, as for servicing. The present invention is useful for plugging such wells below the pump to enable the well pressure thereabove to be released to permit opening up the well to remove the pump, as was explained earlier.

In a well of the type just described and being equipped with the apparatus of this invention as described earlier, the operation thereof may be carried out according to the cycle now to be described, starting with re-running of the pump.

The pump having the latch mechanism on the lower end thereof in the ready condition, as seen in FIG. 3, is lowered into the well and latched onto the stem of the foot valve which is seated in the foot valve seating nipple and plugging the well so that the pump and sucker rod string can be installed. The pump is lowered to its fully seated position. The pump becames connected automatically to the foot valve when the pump is seated in the pump seating nipple.

Next, the pump is unseated and lifted to lift the foot valve to its plugging position, and lifted beyond that position to unlatch it from the foot valve and lifted yet higher so that it will clear the pump seating nipple. Steam is then injected into the well. Pressures are equalized across the poppet valve, and it is moved to its lowermost position. Steam flows down around the pump, through the pump seating nipple and into the foot valve seating nipple and out through its lateral ports, and eventually into the producing formation. Some of the steam will flow down around the foot valve and through its bypass grooves then out the lower end of the foot valve nipple. Injection continues for the desired period.

At the end of the injection period, the well is allowed to flow as long as it will while the pump remains suspended above its seating nipple. The well may flow for quite a period, perhaps 30 to 60 days.

When the well will no longer flow at a satisfactory rate, the pump is lowered and seated again in the pump seating nipple and at the same time reconnected with the poppet valve. The pump is then operated to pump the well as long as an acceptable production rate can be maintained.

At the end of the pumping period, the pump is unseated, disconnected from the foot valve, lifted clear of the pump seating nipple, and steam is injected again to repeat the cycle just described.

When it is desired to remove the pump from the well, the pump is lowered to its seating position to assure that it is connected to the foot valve, and then lifted in order to lift the foot valve to its plugging position. The foot valve should be clean, but if desired, it may be lifted to a position just short of entering the restricted bore of the foot valve nipple. In this position the seating surface of the foot valve and the cylindrical surface immediately therebelow will be just above the lateral ports of the foot valve nipple. If at this time steam is injected for a short period, the foot valve will be washed by the steam, after which it may be lifted to its plugging position. Once the poppet valve is in plugging position, the well pressure thereabove may be reduced to see if the plug is holding. If it is, well pressure may be bled off completely and the rods and pump lifted further to disconnect the pump from the foot valve while well pressure beneath the foot valve 60 holds it in plugging position. The sucker rods and pump may then be removed from the well in the usual manner.

When it is desired to reinstall the pump, it is lowered into the well and latched onto the foot valve as before. The pressure beneath the foot valve should continue to maintain the foot valve plugged in its plugging position.

The pump is then lifted until the pump disconnects from the foot valve and then further lifted until it clears the pump seating nipple. This being accomplished, steam can once again be injected as before.

It is readily seen that the operation of a well equipped with the device of this invention involves methods of plugging the well below the well pump to allow well pressure to be released so that the pump can then be removed, and for reinstalling the pump.

Thus, it has been shown that the device and methods of this invention fulfill all of the objects set forth early in this application.

The foregoing description is presented herein by way of explanation only, and changes in materials, arrangement of parts or elements, or sizes thereof, as well as variations in the methods and equipment, may be had within the scope of the appended claims without departing from the true spirit of this invention.

I claim:

1. Apparatus for plugging a well conduit below a rod-type well pump upon withdrawal thereof from the well, said apparatus including:

(a) foot valve nipple means having a bore extending therethrough and having attachment means at its upper end for attachment to a well conduit, said foot valve nipple means further including:
  (i) lateral port means,
  (ii) an annular seat surface in said foot valve nipple surrounding said bore above said lateral port means, and
  (iii) support means below said lateral port means and a spaced distance below said annular seat surface providing an upwardly facing stop shoulder;

(b) foot valve means in said foot valve nipple means and supportable in its lower, open position by said upwardly facing stop shoulder and movable to an upper, closed position of engagement with said annular seat means to plug the same, said foot valve means including:
  (i) foot valve body means formed with downwardly facing shoulder means engageable with said upwardly facing stop shoulder means in said housing, and a seat surface spaced above said downwardly facing shoulder, and
  (ii) a fishing neck stem on said foot valve body projecting upwardly therefrom and being engageable by means for lifting the foot valve to a position of engagement with said annular seat surface of said foot valve nipple means; and (c) foot valve operator means attachable to the lower end of a well pump for lifting and lowering said foot valve means between its open and closed positions in said foot valve nipple means, said foot valve operator means including:
  (i) housing means having means at its upper end for attachment to the lower end of a well pump, an upwardly opening bore with lateral inlet means for communicating said upwardly opening bore with the exterior of said housing means, and a downwardly opening bore having an internal annular recess in its wall, an internal annular flange spaced below said recess, and limit means thereabove, and
  (ii) releasable latch means carried in said downwardly opening bore and movable between engaging and releasing positions, said latch means having detent means thereon engageable in said internal recess of said downwardly opening bore of said housing means to releasably hold said latch means in its engaging position and being releasable in response to a predetermined tensile load, said latch means having latch members at its lower end for engaging and latching onto the upper end of said fishing neck of said foot valve means, said latch members being held in engaging position by said internal flange of said downwardly opening bore when said latch means is supported in its detented position, and downwardly facing shoulder means on said latch means engageable with said internal flange in said housing means to limit movement of said latch means to its release position, in which position the latch members open to disengage from said fishing neck on said foot valve.

2. The device of claim 1 wherein said detent means of said releasable latching means is a collet having fingers with external bosses thereon engageable in said internal recess of said housing means.

3. The device of claim 1 wherein said fishing neck formed on said foot valve is formed on a stem of sufficient length to project above said annular seat of said foot valve nipple means when said foot valve is supported by said support means.

4. The device of claim 3 wherein said latch members on the lower end of said latch means of said foot valve operator means are dependent collet fingers each having an internal boss formed thereon providing an upwardly facing shoulder engageable with the downwardly facing shoulder of said fishing neck on said stem, said dependent collet fingers being inherently sprung outwardly such that they move outwardly to their disengaging position when they are not confined by said internal flange of said operator housing.

5. The device of claim 1 wherein said foot valve means is provided with fluid bypass means.

6. The device of claims 1, 2, 3, 4, or 5, wherein said foot valve nipple has a portion thereof internally threaded a spaced distance below said internal annular seat, and said upwardly facing stop shoulder is provided by a stop ring threadedly engaged in said internally threaded portion to permit fine adjustment of its position in said tubular housing.

7. The device of claim 6 including means for preserving the adjustment of said stop ring.

8. The method of operating a pumping well, comprising the steps of:

(a) providing a plugging device including a foot valve nipple having an annular seat surface therein and a foot valve for plugging said nipple, and placing said foot valve in said foot valve nipple below said annular seat and attaching said foot valve nipple to the well tubing, and attaching a pump seating nipple in said well tubing a spaced distance above said foot valve nipple;

(b) assembling and installing the well tubing in the well with the pump seating nipple located at the desired level therein;

(c) providing a well pump and operator means for latching onto a fishing neck of said foot valve, and attaching said operator means to the lower end of said well pump;

(d) lowering said well pump into the well on a sucker rod string and carefully seating it in said pump seating nipple so that, said operator means becomes engaged with said foot valve therebelow;

(e) manipulating said sucker rod string to actuate said well pump to pump fluids from the well;

(f) ceasing actuation of the well pump, and lifting the well pump and said foot valve until the foot valve engages the annular seat surface in the foot valve nipple to plug the foot valve nipple; and (g) bleeding pressure from the tubing above the plug, disconnecting said pump from said foot valve, and withdrawing the sucker rods and well pump from the well.

9. The method of claim 8, including the additional steps of:

(a) lowering the well pump into the well and latching the operator means on the lower end thereof with the foot valve;

(b) equalizing pressures across the poppet valve, and lowering the well pump until it becomes seated in the pump seating nipple; and (c) repeating step "e".

10. The method of claim 8 wherein the step of providing the plugging device includes providing upwardly facing shoulder means in said foot valve nipple for supporting said poppet valve therein at a spaced distance from said pump seating nipple and supporting said foot valve thereon when it is in its lower position.

11. The method of claim 10, wherein the step of providing said plugging device further includes providing said foot valve nipple with internal threads a spaced distance below said annular seat and providing a ring with external threads thereon for engaging said internal threads of said foot valve nipple for adjusting the position of said ring relative to said pump when seated in said pump seating nipple.

12. The method of claim 8, 9, 10, or 11, wherein the step of providing said well pump and operator means for said foot valve means includes providing said operator means with latching means for latchingly engaging said foot valve in response to a predetermined axial force being applied thereto to force said operator means against said poppet valve, said latching means also being releasable in response to a predetermined axial load applied thereto tending to pull said operator means away from said foot valve.

13. The method of claim 12, wherein said step of providing said latching means includes providing collet means having upper fingers with external bosses and dependent fingers having internal bosses, said operator means being provided with a tubular portion for housing said collet means and being provided with an internal recess for receiving said external bosses of siid upper collet fingers and with an internal flange for confining said lower collet fingers, said lower collet fingers being inherently sprung outwardly, and providing said collet means and said housing with coengageable means for limiting longitudinal movement of said collet means relative to said housing, said collet being movable in response to a predetermined axial load from an upper position wherein said bosses of said upper collet fingers are engaged in said internal recess of said housing to a lower position wherein said lower collet fingers are no longer confined by the internal flange of said housing, said collet means, when in said lower position, being adapted to receive the upper end of said foot valve and responsive to a predetermined axial load to move to its upper position, causing the lower collet fingers to contract and engage the fishing neck of said foot valve with their inner bosses.

14. The method of claim 9, 10, or 11, wherein the step of providing said foot valve means includes: providing said foot valve with a stem sufficiently long to place said fishing neck above said annular seat in said foot valve nipple when said foot valve is supported on said support mean.

* * * * *